US010396455B2

(12) United States Patent
Klein

(10) Patent No.: US 10,396,455 B2
(45) Date of Patent: Aug. 27, 2019

(54) ANTENNA ASSEMBLY FOR PROVIDING INTERFERENCE MITIGATION

(71) Applicant: AeroAntenna Technology, Inc., Chatsworth, CA (US)

(72) Inventor: Joe Klein, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 16 days.

(21) Appl. No.: 15/434,393

(22) Filed: Feb. 16, 2017

(65) Prior Publication Data

US 2017/0237163 A1 Aug. 17, 2017

Related U.S. Application Data

(60) Provisional application No. 62/296,224, filed on Feb. 17, 2016.

(51) Int. Cl.

| | |
|---|---|
| ***H01Q 3/26*** | (2006.01) |
| ***H01Q 1/28*** | (2006.01) |
| ***H01Q 25/00*** | (2006.01) |
| *H01Q 21/24* | (2006.01) |

(52) U.S. Cl.

CPC ..... *H01Q 3/2611* (2013.01); *H01Q 1/28* (2013.01); *H01Q 3/267* (2013.01); *H01Q 25/001* (2013.01); *H01Q 21/24* (2013.01)

(58) Field of Classification Search

CPC ..... H01Q 3/2611; H01Q 1/28; H01Q 9/0428
See application file for complete search history.

(56) References Cited

U.S. PATENT DOCUMENTS

| | | | | |
|---|---|---|---|---|
| 4,622,437 | A * | 11/1986 | Bloom | G06F 3/045 178/18.05 |
| 4,623,757 | A * | 11/1986 | Marino | G06F 3/045 178/18.03 |
| 6,380,896 | B1 * | 4/2002 | Berger | H01Q 9/0435 343/700 MS |
| 8,471,761 | B1 * | 6/2013 | Hogg | G01S 13/536 342/114 |
| 2007/0254587 | A1 * | 11/2007 | Schadler | H01Q 1/246 455/13.3 |
| 2008/0218400 | A1 * | 9/2008 | Stolarczyk | E21C 35/24 342/22 |
| 2010/0156600 | A1 * | 6/2010 | Duron | H01Q 1/2216 340/10.1 |
| 2011/0090059 | A1 * | 4/2011 | Sadr | G06K 7/0008 340/10.1 |
| 2011/0285397 | A1 * | 11/2011 | Hu | H01P 5/02 324/318 |
| 2013/0201070 | A1 * | 8/2013 | Parsche | H01Q 7/00 343/786 |

* cited by examiner

*Primary Examiner* — Graham P Smith
*Assistant Examiner* — Jae K Kim
(74) *Attorney, Agent, or Firm* — Burr Forman McNair

(57) ABSTRACT

An antenna assembly may include a right hand circularly polarized (RHCP) antenna, a left hand circularly polarized (LHCP) antenna, an RF nuller operably coupling the RHCP antenna and LHCP antenna to a difference element, and a digital nuller operably coupled to the difference element.

8 Claims, 5 Drawing Sheets

ANTENNA ASSEMBLY FOR PROVIDING INTERFERENCE MITIGATION

CROSS REFERENCE TO RELATED APPLICATIONS

This application claims priority to U.S. application No. 62/296,224 filed Feb. 17, 2016, the entire contents of which are hereby incorporated by reference it its entirety.

TECHNICAL FIELD

Various example embodiments relate generally to antenna technology, and more particularly relate to an antenna assembly for providing interference mitigation.

BACKGROUND

Antennas can be structured to exhibit a variety of desirable characteristics based on the needs of the communication environment in which they will be used. However, certain use cases may provide limitations on antenna design that can correspondingly impact the ability of designers to provide antennas with optimal characteristics. As an example, aviation antennas not only operate in challenging communication environments, but must typically be designed to withstand unique forces and weather conditions with a further understanding of their potential impact on aircraft safety and certification.

In many cases, aircraft may have communications equipment on board that interfaces with other communications equipment located at ground based, satellite based, or aircraft based sites. The signals provided for use with these various pieces of communications equipment can create hostile communications environments relative to dealing with interference issues. Although various signal processing techniques may be employed to attempt to deal with interference issues, it may be desirable to provide antenna structures that facilitate interference mitigation.

BRIEF SUMMARY OF SOME EXAMPLES

Some example embodiments may therefore provide an antenna assembly that may include a right hand circularly polarized (RHCP) antenna, a left hand circularly polarized (LHCP) antenna, an RF nuller operably coupling the RHCP antenna and LHCP antenna to a difference element, and a digital nuller operably coupled to the difference element.

In another example embodiment, antenna assembly may be provided to include multiple right hand circularly polarized (RHCP) antennas, multiple left hand circularly polarized (LHCP) antennas, an RF nuller operably coupling the RHCP antennas and LHCP antennas to difference elements, and a digital nuller operably coupled to the difference elements.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
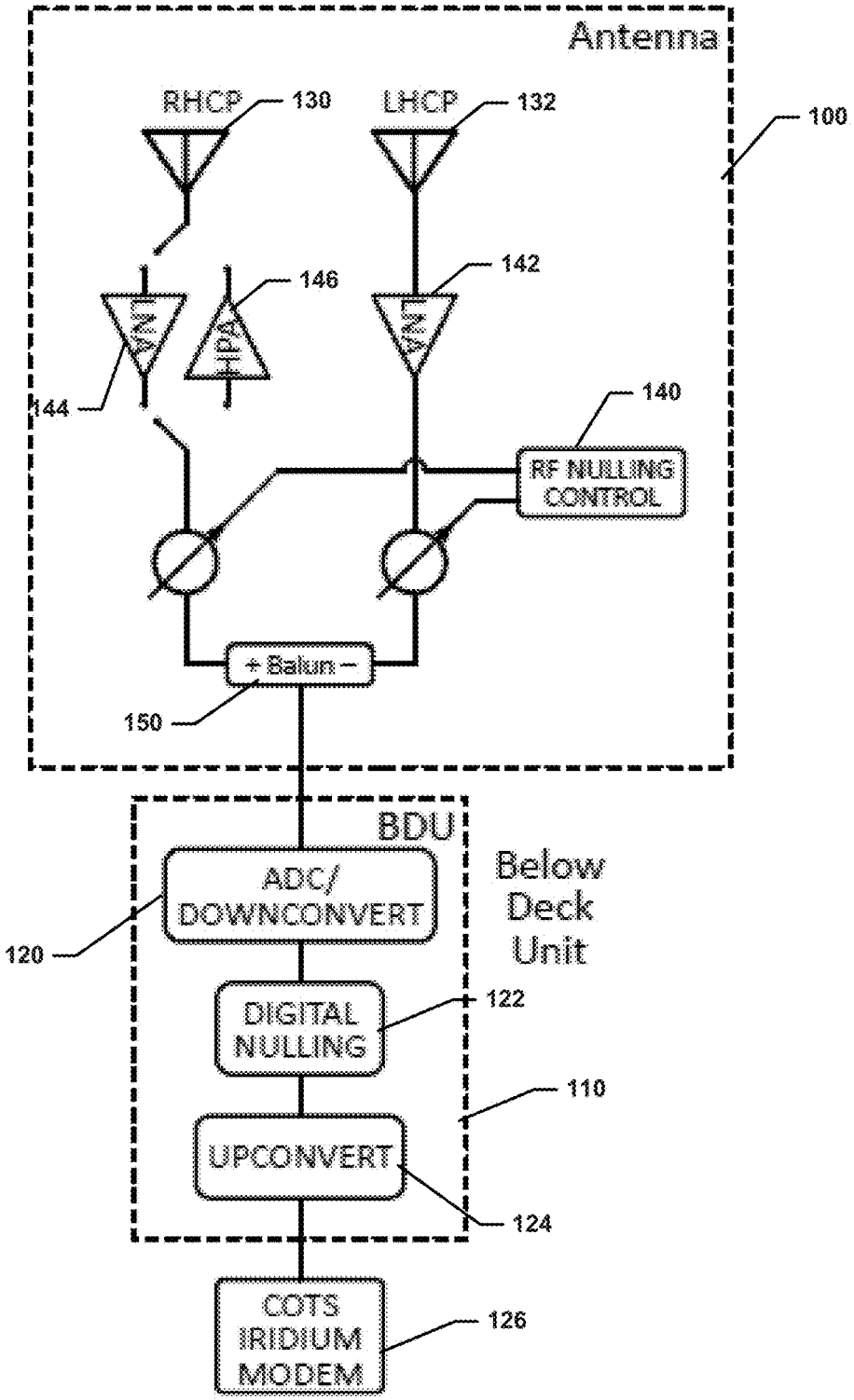
FIG. 1 illustrates a block diagram of an antenna assembly according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

FIG. 1 illustrates a block diagram of a system according to an example embodiment. As shown in FIG. 1, the system may include an antenna and RF nulling assembly 100, which may be substantially mounted outside an aircraft. The system may also include a below deck unit (BDU) 110. Internal components of the system may be operably coupled by suitable wiring or cabling (e.g., coaxial cables) and/or adapters. The BDU 110 may be substantially provided internal to the aircraft, and may include a power supply for the system and other digital electronics such as, for example, and ADC down converter 120, a digital nuller 122 and an upconverter 124. The BDU 110 may be further operably coupled to a modem 126, which could generally be operably coupled to communications equipment onboard the aircraft.

In an example embodiment, the antenna and RF nulling assembly 100 may include a first antenna element (e.g., a Right Hand Circularly Polarized (RHCP) antenna 130) and a second antenna element (e.g., an Orthogonal Left Hand Circularly Polarized (LHCP) antenna 132). An output of the LHCP antenna 132 may be provided to an RF nuller 140 via a low noise amplifier (LNA) 142. In some cases, the RHCP antenna 130 may be operably coupled to the RF nuller 140 via an LNA 144 and/or a high power amplifier (HPA) 146. A difference element 150 may be provided to determine a difference signal between outputs of the signals provided by the RHCP antenna 130 and the LHCP antenna 132 via the RF nuller 140.

Accordingly, the first and second antenna elements may form a first level of mitigation based on the generation of a difference signal between the first and second antenna elements. After the difference signal is generated, the remaining signal and interference is sampled digitally, and Digital Signal Processing and filtering is applied at the BDU 110 to lower the relative level of unwanted signal to power levels that the receiver can handle.

Figure 2:
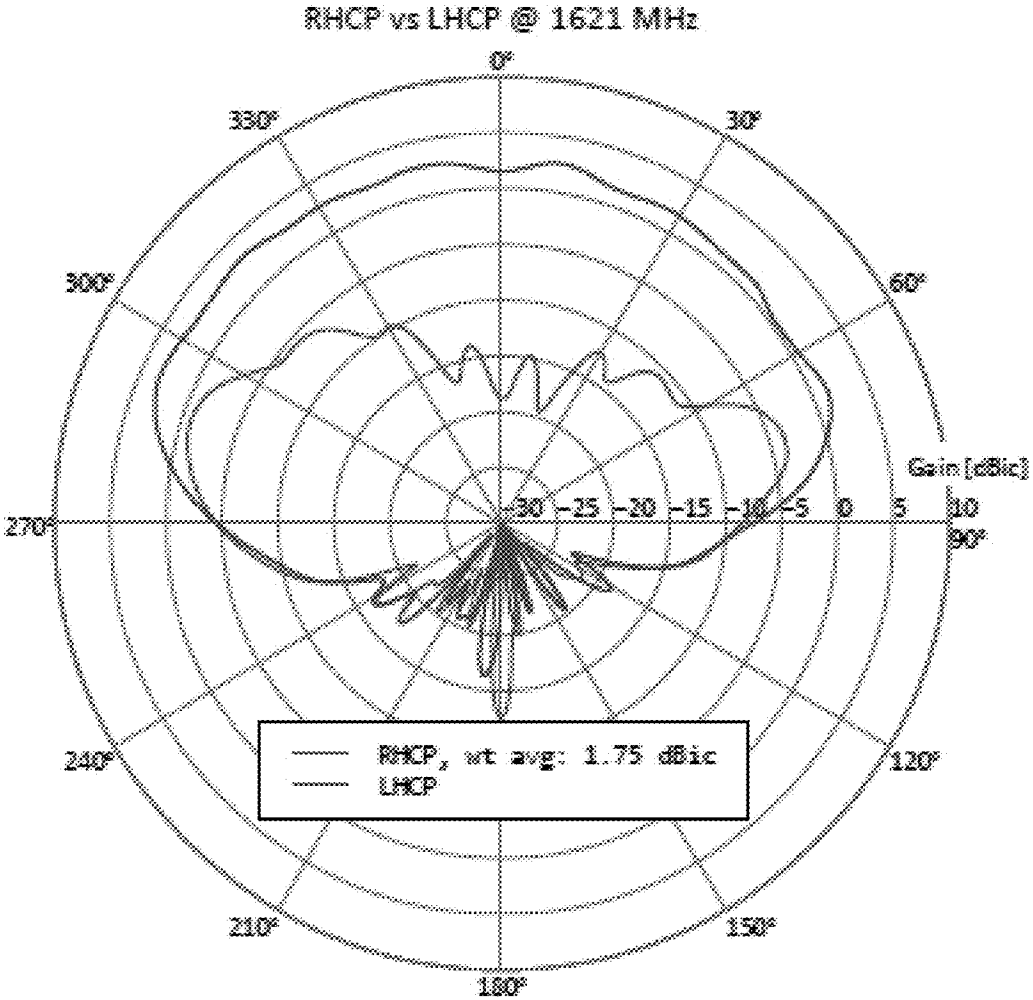
FIG. 2 illustrates a polar plot of RHCP and LHCP radiation patterns of an antenna assembly in accordance with an example embodiment.
Figure 3:
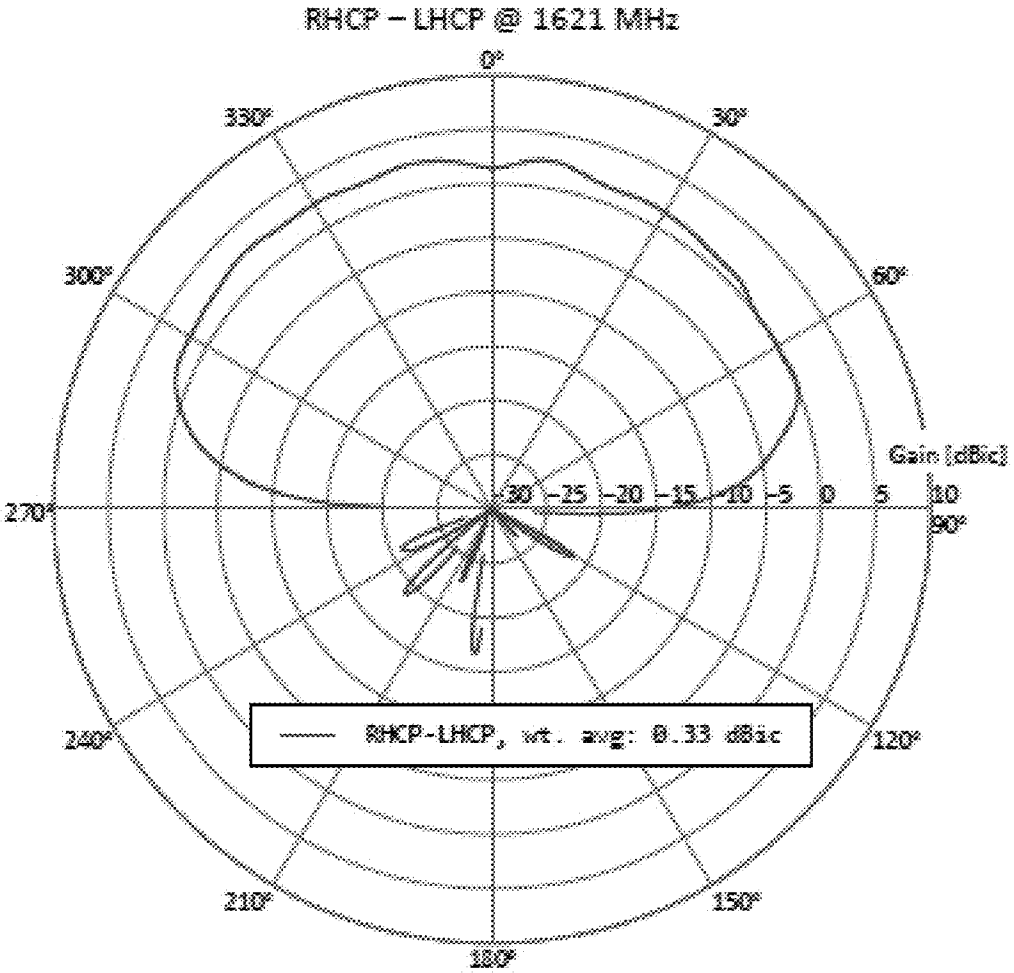
FIG. 3 illustrates a polar plot of an RHCP-LHCP radiation pattern of an antenna assembly in accordance with an example embodiment.
Figure 4:
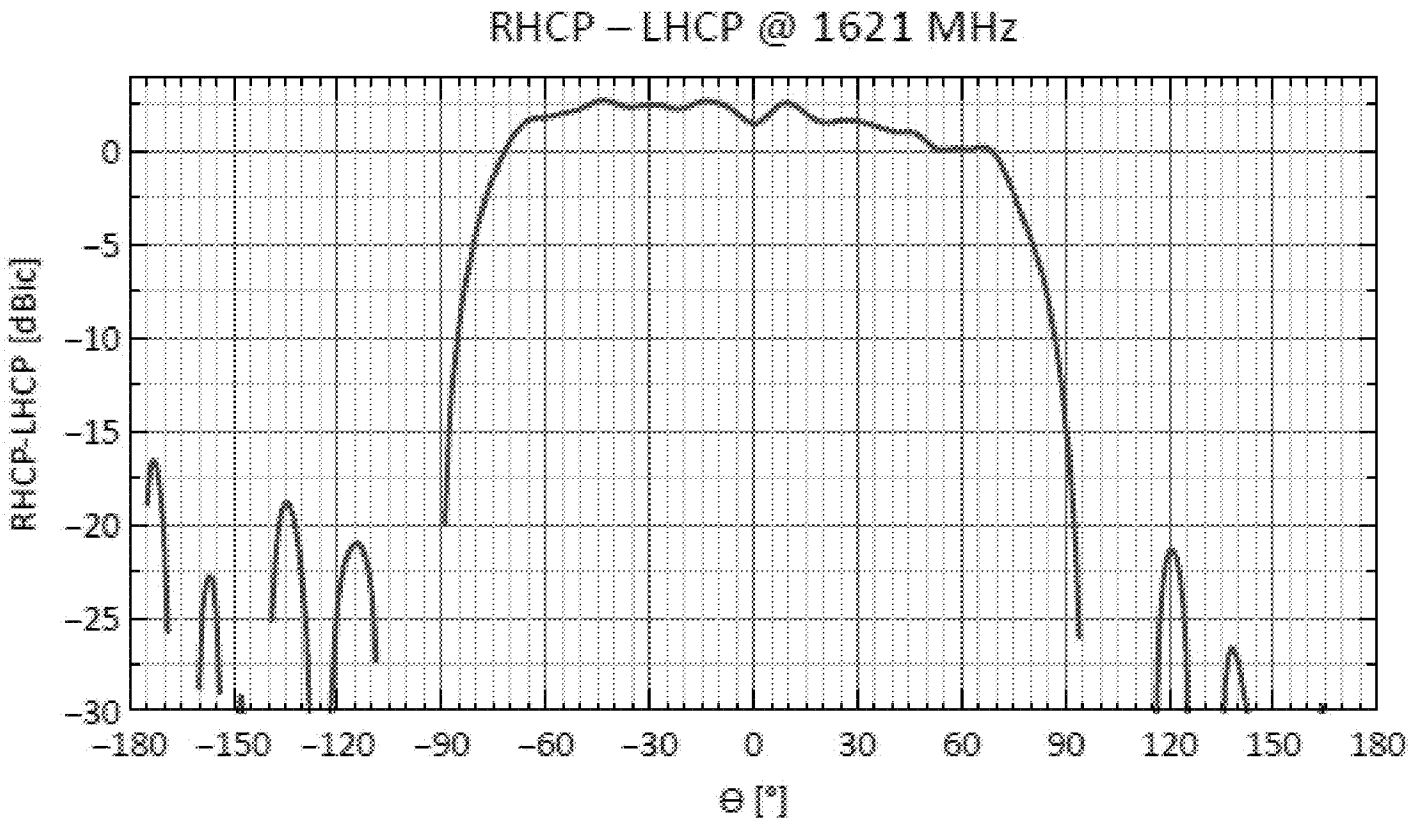
FIG. 4 illustrates a plot of RHCP-LHCP vs angle for an antenna according to an example embodiment.

In some examples, interference from one source may be at an unpredictable location. Thus, it may be appreciated that steering a null toward the interference direction will reduce interference from such source. The coarse nulling is done by the RF nulling device 122 and fine nulling is done by digital nuller 140 FIG. 2 illustrates the radiation patterns for the RHCP antenna 130 and LHCP antenna 132 in accordance with an example embodiment. FIG. 4 illustrates the difference between the RHCP antenna 130 and LHCP antenna 132 in accordance with an example embodiment. The difference signal (RHCP-LHCP) is as low as −20 dB at the horizon in this example. At the same time, the weighted average of the RHCP signal compared to the difference signal is only impaired by less than 1.5 dB. Roughly speaking, at least 18.5 dB of isolation is achieved by using the difference signal. This reduces the unwanted signal to levels where the unwanted signal can be digitally sampled and effectively reduced.

The antenna will employ band pass RF filtering to protect GPS without nulling, and will use as much band pass filtering on any given channel to reject interfering signals as much as possible in the antenna space. Experience has shown that the total nulling required for some applications may be about 55 dB. Approximately 20 dB is assigned to the RF nuller 140 in the antenna and the remaining 35 dB may be accomplished by the digital nuller 122. In some cases, the nuller may be "non beam steered" and therefore should not need certain controls (e.g., ITAR controls).

Figure 5:
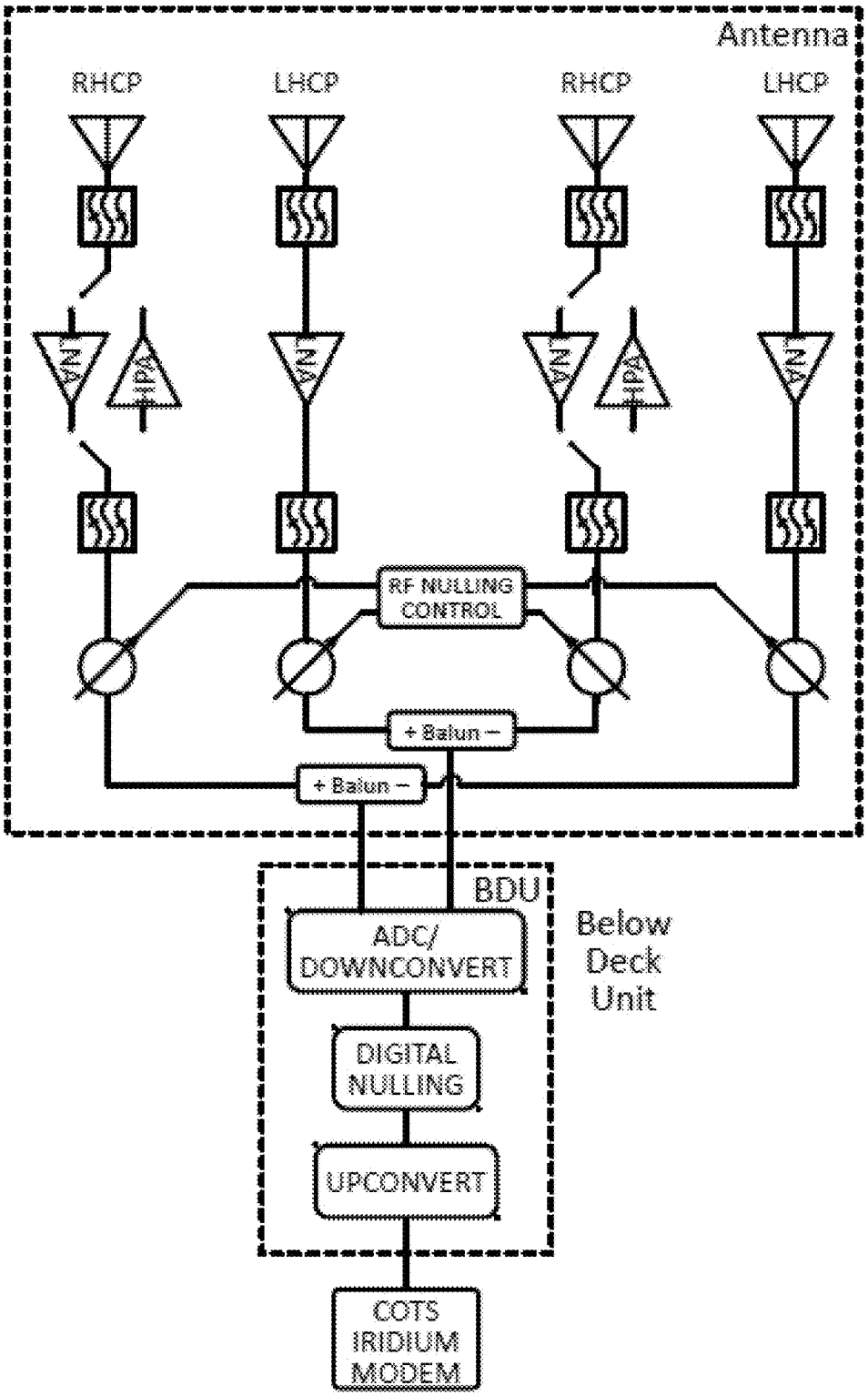
FIG. 5 illustrates a block diagram of an antenna assembly employing multiple RHCP and LHCP according to an example embodiment.

Although FIG. 1 illustrates an example with a single RHCP and LHCP antenna, it should be appreciated that multiple such antennas may be employed in some embodiments. FIG. 5 illustrates a block diagram of such an example. As can be appreciated from FIG. 5, difference elements may be provided between respective pairs of RHCP and LHCP and the difference elements may output to a BDU similar to that of FIG. 1.

Some example embodiments may provide a capable system for aircraft antenna installation to support multiple satellites such as in a global navigation satellite system (GNSS). Some example embodiments may allow GNSS receivers to replace GPS receivers with minimal effort to improve system performance.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation. An example shown in FIG. 5 is taking advantage of adding another polarization to each antenna in the case shown in FIG. 4 in the case of FIG. 5 an orthogonal polarization is added to each antenna. The unwanted signal is double differenced in FIG. 5 and therefore higher rejection can be achieved. If n antennas are used than the signal can be n times differenced achieving higher rejection of the unwanted signal.

That which is claimed:

1. An antenna assembly comprising:

a right hand circularly polarized (RHCP) antenna;

a left hand circularly polarized (LHCP) antenna;

an RF nuller operably coupling the RHCP antenna and LHCP antenna to a balun circuit or balun component configured to operate as a difference element; and a digital nuller operably coupled to the balun circuit or balun component, wherein the RF nuller operates to perform coarse nulling before the balun circuit or balun component, and the digital nuller operates to perform fine nulling after the balun circuit or balun component to conduct null steering to steer a null in a direction of interference received at the antenna assembly.

2. An antenna assembly comprising:

multiple right hand circularly polarized (RHCP) antennas;

multiple left hand circularly polarized (LHCP) antennas;

an RF nuller operably coupling the RHCP antennas and LHCP antennas to respective balun circuits or balun components configured to operate as difference elements; and a digital nuller operably coupled to the respective balun circuits or balun components wherein the RF nuller operates to perform coarse nulling before the balun circuit or balun component, and the digital nuller operates to perform fine nulling after the balun circuit or balun component to conduct null steering to steer a null in a direction of interference received at the antenna assembly.

3. The antenna assembly of claim 1, further comprising a downconverter between the balun circuits or balun components and the digital nuller such that fine nulling is performed on a downsampled signal, and an upconverter disposed at an output of the digital nuller.

4. The antenna assembly of claim 2, further comprising a downconverter between the balun circuits or balun components and the digital nuller such that fine nulling is performed on a downsampled signal, and an upconverter disposed at an output of the digital nuller.

5. The antenna assembly of claim 2, wherein each one of the multiple RHCP antennas and each one of the multiple LHCP antennas is also orthogonally polarized.

6. An antenna assembly comprising:

a right hand circularly polarized (RHCP) antenna mounted on an aircraft;

a left hand circularly polarized (LHCP) antenna mounted on the aircraft;

an RF nuller operably coupling the RHCP antenna and LHCP antenna to a difference element; and a digital nuller operably coupled to the difference element, wherein the RF nuller operates to perform coarse nulling on a signal received near the horizon relative to the aircraft before the difference element, and the digital nuller operates to perform fine nulling on the signal after the difference element to conduct null steering to steer a null in a direction of interference received at the antenna assembly.

7. The antenna assembly of claim 6, wherein the RF nuller is beam steered.

8. The antenna assembly of claim 6, wherein the RF nuller is non beam steered.

* * * * *